US008198973B2

(12) United States Patent
Fukui et al.

(10) Patent No.: US 8,198,973 B2
(45) Date of Patent: Jun. 12, 2012

(54) TRANSFORMER

(75) Inventors: Kazuyuki Fukui, Tainai (JP); Katsutoshi Inagaki, Niigata (JP); Masao Hosokawa, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 530 days.

(21) Appl. No.: 11/704,207

(22) Filed: Feb. 9, 2007

(65) Prior Publication Data

US 2008/0068121 A1 Mar. 20, 2008

(30) Foreign Application Priority Data

Sep. 15, 2006 (JP) ..... 2006-250237

(51) Int. Cl.
*H01F 27/24* (2006.01)

(52) U.S. Cl. ..... 336/219; 427/387

(58) Field of Classification Search ..... 336/219; 427/387; 156/185; 428/692.1
See application file for complete search history.

(56) References Cited

U.S. PATENT DOCUMENTS 3,036,247 A * 5/1962 Kumm ..... 335/281
3,085,315 A * 4/1963 Manning ..... 29/605
3,100,295 A * 8/1963 Schweizerhof ..... 365/66
3,296,233 A * 1/1967 Corte et al. ..... 525/359.3
3,520,052 A * 7/1970 Hoffmann ..... 438/17
3,810,058 A * 5/1974 White et al. ..... 336/196
3,881,191 A * 4/1975 Potter et al. ..... 360/121
4,668,338 A * 5/1987 Maydan et al. ..... 438/714
4,668,365 A * 5/1987 Foster et al. ..... 204/192.23
4,871,925 A * 10/1989 Yamauchi et al. ..... 307/106
4,892,773 A * 1/1990 Chenoweth et al. ..... 428/121
5,072,205 A * 12/1991 Arakawa et al. ..... 336/213
5,122,227 A * 6/1992 Ott ..... 438/3
5,138,393 A * 8/1992 Okamura et al. ..... 335/297
5,576,098 A * 11/1996 Arimoto et al. ..... 428/815.2
5,861,791 A * 1/1999 Schneider ..... 336/205
6,331,363 B1 * 12/2001 DeCristofaro et al. ..... 428/800
6,346,337 B1 * 2/2002 DeCristofaro et al. ..... 428/800

(Continued)

FOREIGN PATENT DOCUMENTS

CN 1 476 488 A 2/2004

(Continued)

OTHER PUBLICATIONS

Indian Office Action dated Jan. 29, 2010 in English.

(Continued)

*Primary Examiner* — Anh Mai
*Assistant Examiner* — Joselito Baisa
(74) *Attorney, Agent, or Firm* — Antonelli, Terry, Stout & Kraus, LLP.

(57) ABSTRACT

The iron core characteristics of an amorphous iron core transformer degrade significantly when machining from material into a transformer. This phenomenon is suppressed to improve the iron core characteristics of the finished transformer products. In the present invention, an insulating thin film is formed in at least one side of an amorphous ribbon, and is formed in at least one for each plurality of amorphous ribbons of iron core material. Moreover, in the surface of the amorphous ribbon that is the iron core material of the amorphous iron core transformer, silane or the like is vapor deposited to form an insulating thin film, the insulating thin film being formed in the thickness of approximately 1 μm. With such structure, an increase in eddy current loss occurring when machining from the material into a transformer is suppressed to reduce no-load loss of the transformer.

11 Claims, 7 Drawing Sheets

U.S. PATENT DOCUMENTS

| | | | | |
|---|---|---|---|---|
| 6,348,275 | B1 * | 2/2002 | DeCristofaro et al. | 428/800 |
| 6,377,156 | B2 * | 4/2002 | Farrar et al. | 336/200 |
| 6,558,553 | B1 * | 5/2003 | Amal et al. | 210/695 |
| 6,667,536 | B2 * | 12/2003 | Chaudhry et al. | 257/531 |
| 7,126,095 | B2 * | 10/2006 | Alfredeen | 219/622 |
| 7,173,509 | B2 | 2/2007 | Kumano et al. | |
| 7,445,852 | B2 * | 11/2008 | Maruko et al. | 428/611 |
| 2008/0231409 | A1 * | 9/2008 | Kugai et al. | 336/233 |

FOREIGN PATENT DOCUMENTS

| | | |
|---|---|---|
| JP | 56-118306 | 9/1981 |
| JP | 59-181522 | 10/1984 |
| JP | 61-071612 | 4/1986 |
| JP | 62-052906 | 3/1987 |
| JP | 05-251252 | 9/1993 |
| JP | 08-045723 | 2/1996 |
| JP | 09-237719 | 9/1997 |
| JP | 11-176653 | 7/1999 |
| JP | 11-300450 | 11/1999 |
| JP | 2002-285304 | 10/2002 |
| JP | 2005-217289 | 8/2005 |
| JP | 2006-128539 | 5/2006 |
| KR | 2004-0015035 | 2/2004 |
| TW | 200302495 A | 8/2003 |

OTHER PUBLICATIONS

CN Office Action of Application No. 200710078774 dated Mar. 22, 2010 in English.

TW Office Action of Appln No. 09920082310, dated Sep. 9, 2006.

Japanese Office Action mailed Jan. 4, 2011 in connection with Japanese Application No. 2006-250237; 1 page; Japanese Patent Office, Japan.

Japanese Office Action mailed Nov. 29, 2011 in connection with Japanese Application No. 2006250237; 3 pages; Japanese Patent Office, Japan.

* cited by examiner

TRANSFORMER

INCORPORATION BY REFERENCE

The present application claims priority from Japanese application JP2006-250237 filed on Sep. 15, 2006, the content of which is hereby incorporated by reference into this application.

BACKGROUND OF THE INVENTION

The present invention relates to structures of an amorphous iron core transformer, and particularly relates to structures of an amorphous iron core and the manufacturing methods thereof.

As conventional techniques in conjunction with the present invention, although as the iron core structure of a high frequency transformer there is known a method of inserting insulation sheet between amorphous ribbons and thereby suppressing increase in eddy current loss, this has not been put in practical use because in a commercial frequency transformer, the effect of reduction in the iron core space factor due to the insertion of the insulation sheet is large as compared with the improvement effect of the eddy current. Moreover, although in forming the insulating thin film, an insulating coating of magnesium oxide or the like is carried out in magnetic steel sheets that are the most common magnetic material for transformers, the thickness thereof is thick and this is thus not applicable to materials like amorphous ribbons. Moreover, although for the thin material such as the amorphous ribbon, Patent Document 1 (JP-A-8-45723) proposes a method of coating and drying a fluid with respect to nano crystal alloy, for example, it is difficult to form a uniform and thin insulating thin film.

SUMMARY OF THE INVENTION

The amorphous ribbon that is an iron core material of amorphous iron core transformers does not have a sufficient insulation performance because the insulating thin film in the material surface is just an oxidative thin film formed in the metal surface. On the other hand, in the manufacturing process of the amorphous iron core transformers, although the material is laminated so as to form the iron core, the surface thin film of the amorphous ribbon has a poor insulation performance and the lamination equivalently increases the thickness, thereby degrading the eddy current loss that is in proportion to the square of the thickness of a material plate. An object of the present invention is to manufacture transformers without degrading the low-loss characteristic of the material concerning the transformer using the amorphous ribbon as the iron core material, and without reducing the iron core space factor.

In the present invention, in order to achieve the above object, silane or the like is vapor deposited onto the surface of the amorphous ribbon to form an insulating thin film. Moreover, the insulating thin film can be formed in the thickness of approximately 1 μm, thereby allowing the object to be achieved without reducing the iron core space factor.

The degradation of eddy current loss occurring due to the lamination of material in the iron core manufacturing process can be reduced so that loss property of transformers can be improved.

Other objects, features and advantages of the invention will become apparent from the following description of the embodiments of the invention taken in conjunction with the accompanying drawings.

DETAILED DESCRIPTION OF THE PREFERRED EMBODIMENTS

Hereinafter, best mode embodiments of the present invention will be described using the accompanying drawings.

Figure 1:
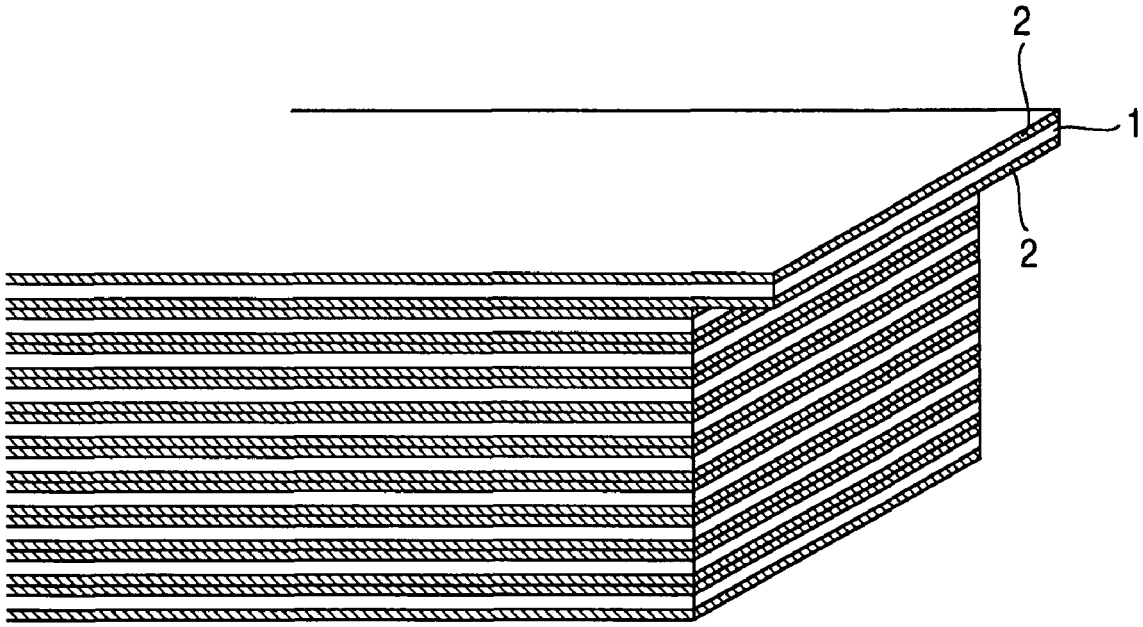
FIG. 1 is a configuration diagram showing Embodiment 1 of a block of wound core according to the present invention.
Figure 2:
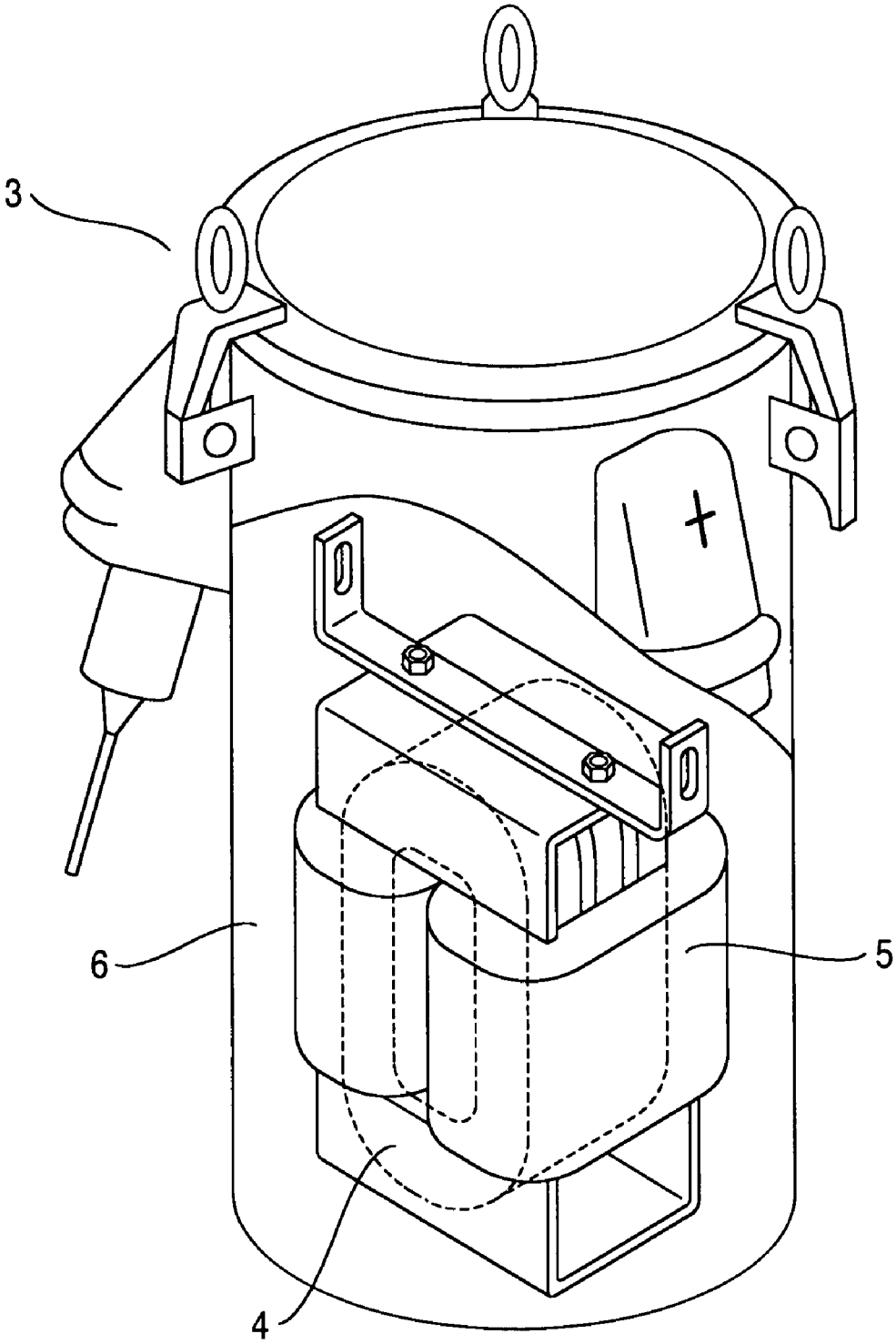
FIG. 2 is a configuration diagram of a transformer as an embodiment of the present invention.
Figure 3:
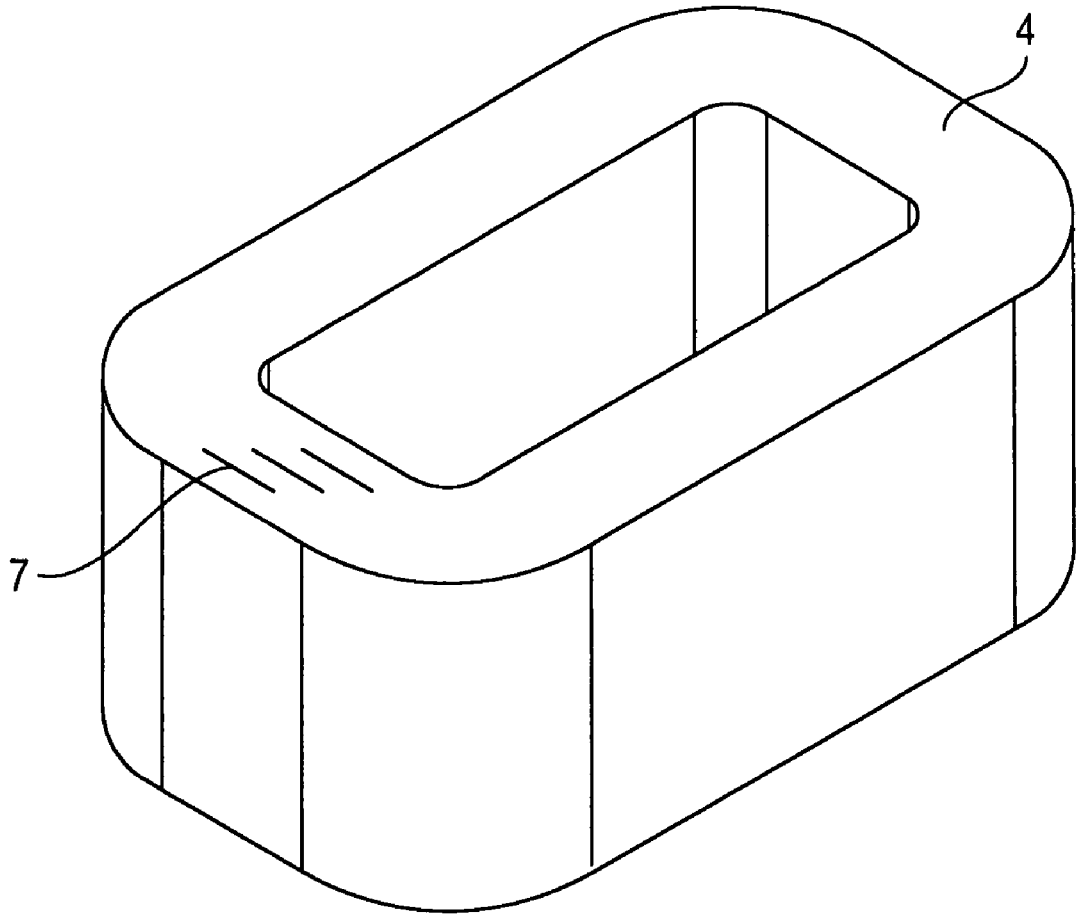
FIG. 3 is an explanatory view of a wound core 4.
Figure 4:
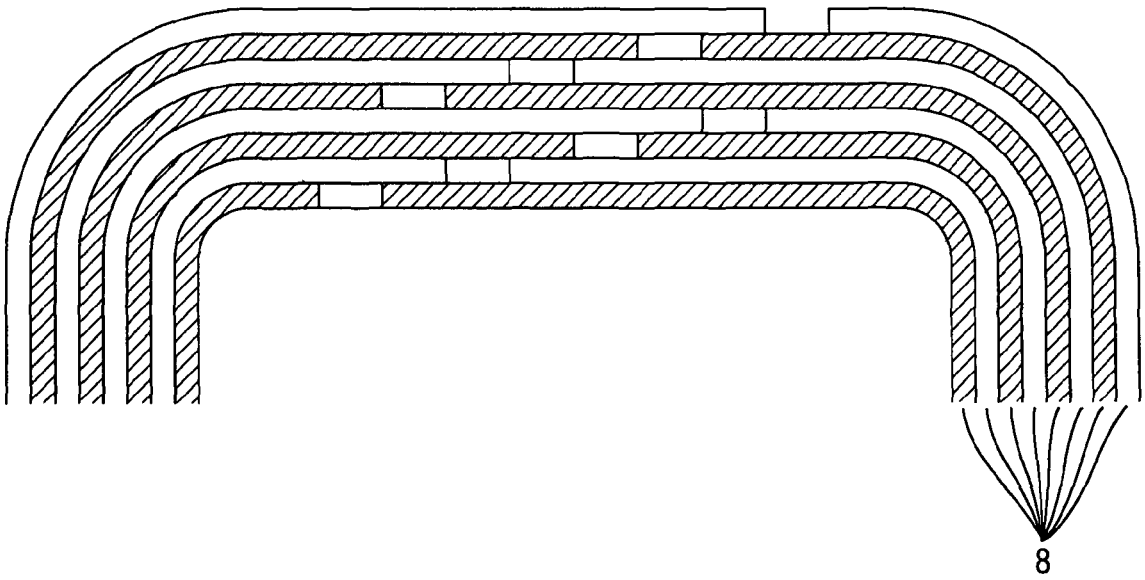
FIG. 4 is an explanatory view of a lap part 7 in the wound core 4.
Figure 5:
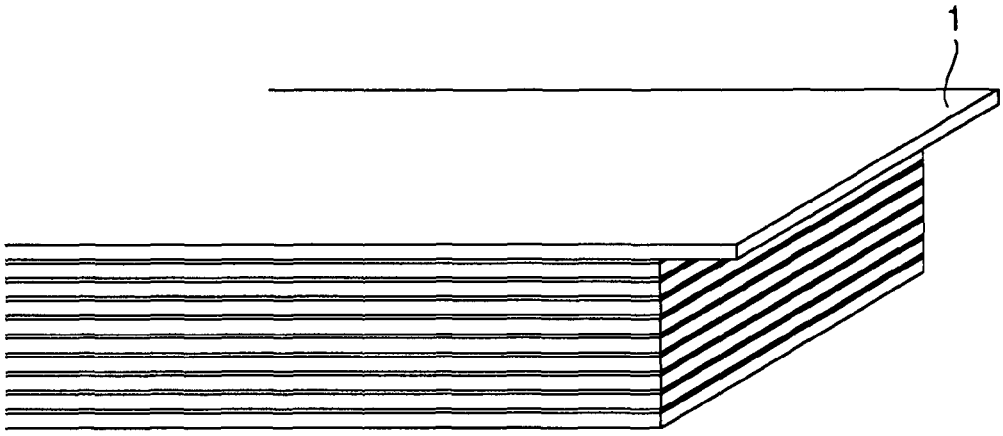
FIG. 5 is a configuration diagram of a block of current wound core.
Figure 6:
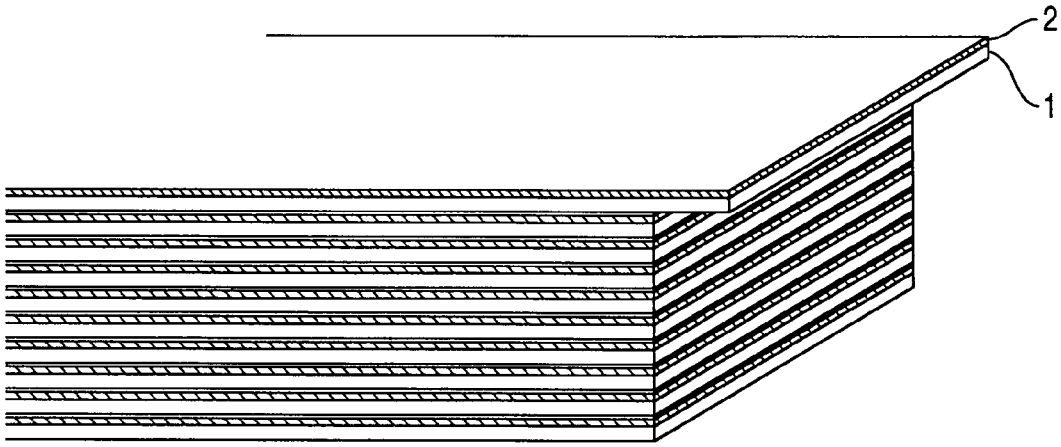
FIG. 6 is a configuration diagram showing Embodiment 2 of a block of wound core in the present invention.
Figure 7:
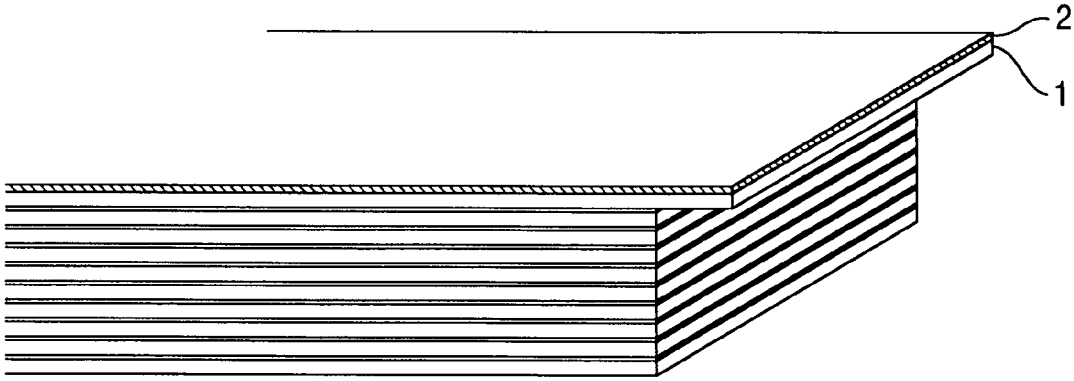
FIG. 7 is a configuration diagram showing Embodiment 3 of a block of wound core in the present invention.
Figure 8:
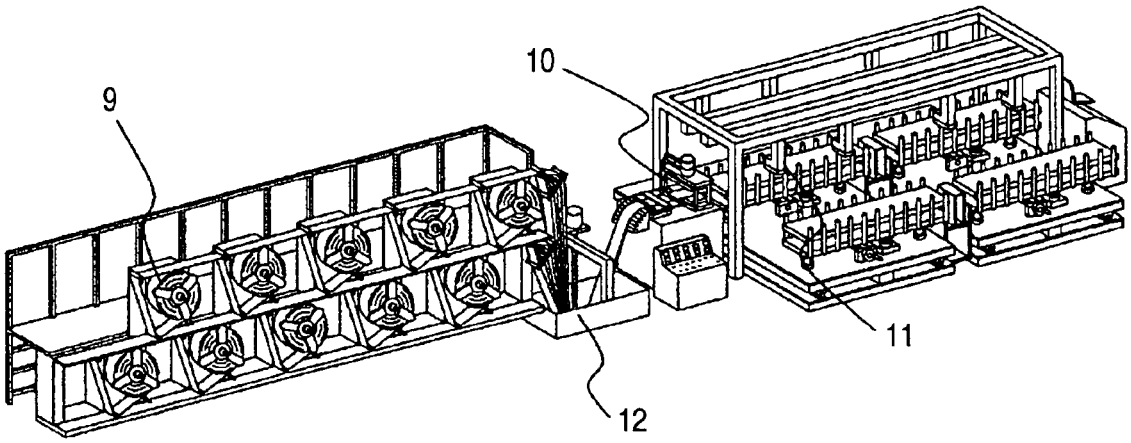
FIG. 8 is an overall configuration diagram of a manufacturing equipment in the present invention.
Figure 9:
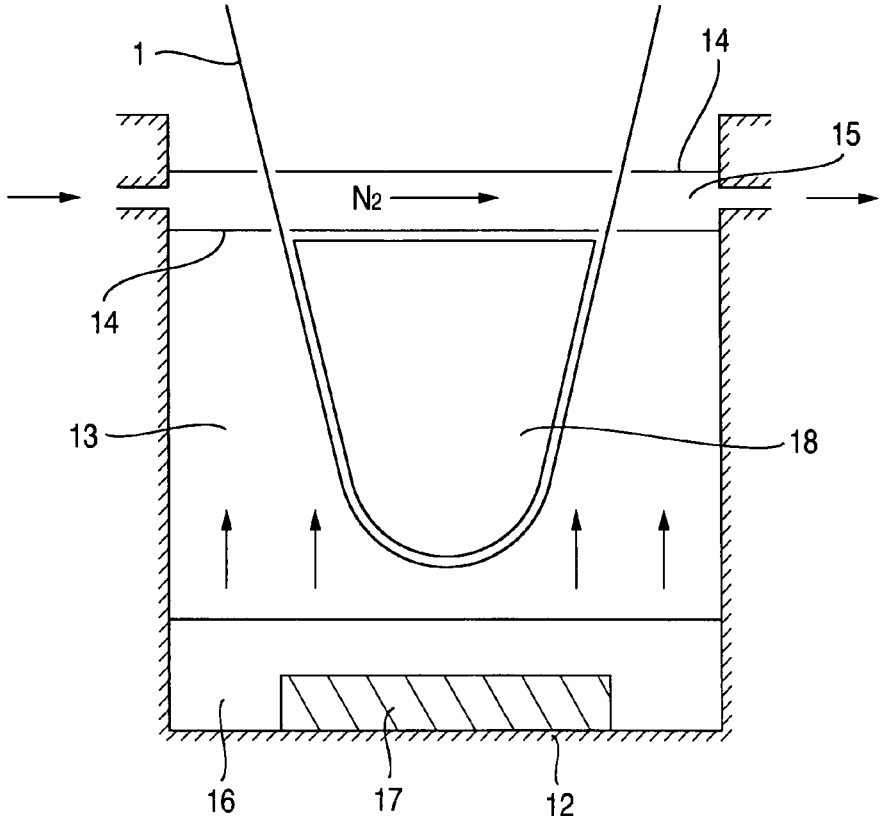
FIG. 9 is an explanatory view of a vapor deposition apparatus 12 in the present invention.
Figure 10:
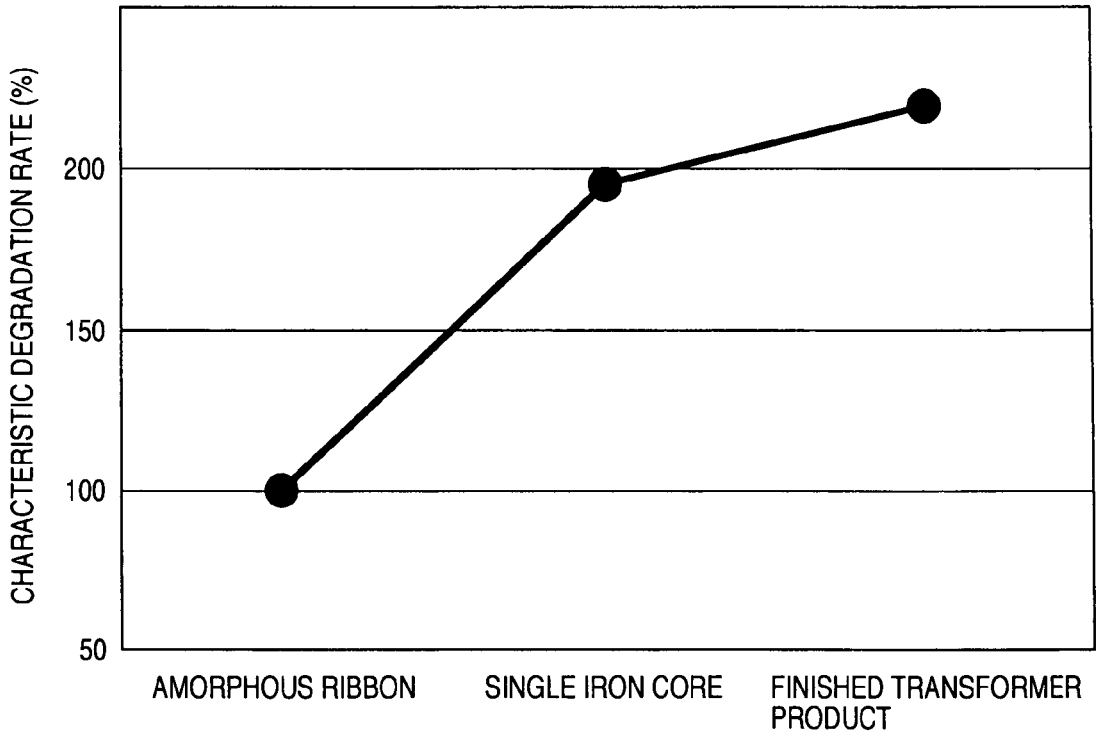
FIG. 10 is an explanatory view showing a general characteristic change for each manufacturing step of a single phase amorphous iron core transformer.

FIG. 2 is a configuration diagram of a transformer as a first embodiment of the present invention, FIG. 3 is an explanatory view of a wound core used in the transformer of FIG. 2, FIG. 4 is a schematic view of a lap part of an iron core, FIG. 5 is a configuration diagram within a block in the conventional amorphous iron core, FIG. 1, FIG. 6, and FIG. 7 are examples of forming an insulating thin film of an amorphous ribbon in the present invention, FIG. 8 and FIG. 9 are explanatory views concerning the manufacture of wound cores in the present invention and a method for forming the insulating thin film, and FIG. 10 is an explanatory view of a characteristic change in each manufacturing step of a single phase amorphous iron core transformer.

In FIG. 2, reference numeral 3 represents a pole transformer, reference numeral 4 represents a wound core for forming a magnetic circuit, reference numeral 5 represents an exciting coil for forming an electric circuit, and reference numeral 6 represents a container for mechanically protecting the transformer. For the wound core 4, as shown in FIG. 3 to FIG. 5 an amorphous ribbon 1 is laminated in a plurality of layers, which is referred to as a block 8, and by laminating this block 8 while displacing in the winding-around direction the wound core 4 is constituted. In the amorphous ribbon laminated in a plurality of layers, in the same block there exists a part that is formed from mutually abutting or overlapping the both ends, the part being referred to as a lap part 7. This is because the lap part 7 is opened to combine when inserting the wound core 4 in the coil 5.

Although the pole transformer is shown here, adaptation to the amorphous iron cores used in an oil immersed transformer and a molded transformer is also possible.

The present invention is characterized in that an insulating thin film is formed in the laminated amorphous ribbon, and as the formation of the insulating thin film, various kinds of forming patterns may be considered as shown in FIG. 1, FIG. 6, or FIG. 7. FIG. 1 is a case where an insulating thin film 2 is formed in both sides of each amorphous ribbon, wherein the space factor will decrease slightly while improvement in the iron loss characteristic is large. Moreover, FIG. 6 is a case where the insulating thin film 2 is formed in one side of each amorphous ribbon 1 and FIG. 7 is a case where the insulating thin film 2 is formed in one side of the outermost periphery of the block 8, wherein a decrease in the space factor is minimized while the characteristic improvement effect is small. In addition, a similar effect may be obtained also by forming the insulating thin film 2 in the most inner periphery of the block or in one side of the internal layer.

The thickness of the insulating thin film of the present invention is formed on the order of 1 μm while the thickness of the amorphous ribbon is typically on the order of 25 μm. It is preferable that the thickness of the thin film of this insulation material is as thin as possible so as to laminate the amorphous ribbon.

FIG. 8 shows a manufacturing equipment of the iron cores. The wound core 4 is pulled out of 10 amorphous ribbon material hoops 9, and is cut into a specified dimension at a cutting device 10, and is stacked by a conveying equipment 11 and is then wound around and shaped to manufacture. In the present invention, silane is vapor deposited on the surface of the amorphous ribbon with the deposition apparatus 12 in the step of pulling out the material from the amorphous ribbon material hoop 9 to the cutting device 10. In addition, although the material may be wound up from the material hoop 9 onto a material hoop again via the deposition apparatus 12 separately, and then be passed to the current wound core manufacturing equipment, it is preferable to employ the manufacturing equipment as shown in this figure, considering the manufacturing process.

FIG. 9 shows an embodiment of the deposition apparatus 12. The amorphous ribbon 1 enters a reaction chamber 13 that is partitioned from a partition 14 by a shielding layer 15, such as $N_2$ or dry air. The amorphous ribbon 1 having entered the reaction chamber 13 follows a guide 18, and again, passes through the partition 14 and shielding layer 15 to go outside. At this time, the bottom of the reaction chamber 13 is filled with silane 16, which is evaporated with a heater 17. This evaporated silane 16 is vapor deposited onto the surface of the amorphous ribbon 1 to form the thin film. In this embodiment, the thin film is formed in the surface of one side of 10 sheets because 10 amorphous ribbon hoops 9 are passed therethrough at once. Accordingly, by dividing the guide 18 for each arbitrary number of sheets it is possible to form the thin film in any position.

In addition, the silane to vapor deposit is shown in Table 1. Materials of various kinds of composition system are applicable.

TABLE 1

Various kinds of silane materials

| Silane material | Representative chemical name<br>Structural formula |
|---|---|
| Straight silicone oil system | Dimethyl silicone oil<br>$Si(CH_3)_3$—$[SiO(CH_3)_2]_N$—$Si(CH_3)_3$ |
| Alkoxysilane system | Tetramethoxy silane<br>$Si(OCH_3)_4$ |

Next, the iron-loss reduction effect according to the present invention is described.

As shown in FIG. 10, at present state, the degradation rate, i.e., building factor, in the manufacturing process of amorphous iron core transformers is approximately 200% when turning the amorphous ribbon into a wound core, and this causes the characteristic degradation. This may be primarily because the lamination of the amorphous ribbons increases the apparent thickness and increases the eddy current loss.

Accordingly, by forming the insulating thin film in the surface of the amorphous ribbon of the present invention, an increase in the eddy current loss can be suppressed and no-load loss of the transformer can be reduced.

As the activities to preserve the earth's environment increase socially, it is requested to provide low-loss devices with regard to the power distribution equipment and materials, and the applicability of the present invention is extremely high.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A transformer comprising an iron core made by forming an amorphous ribbon toroidally in a plurality of layers; and an exciting coil, wherein at least one insulating thin film having a thickness of approximately 1 μm is formed from at least one silicone material on at least one side of the amorphous ribbon for each of the plurality of layers of the amorphous ribbon forming the iron core by vapor deposition treatment during a manufacturing process to machine an amorphous ribbon material into a transformer iron core, the iron core is made by a process comprising the steps of:

unwinding an amorphous ribbon material from a hoop;

vapor depositing a thin insulating film of silane on at least one major surface of the amorphous ribbon material while the amorphous ribbon material is unwound from the hoop, wherein the step of vapor depositing a thin insulating film of silane comprises passing the amorphous ribbon material into a deposition apparatus, through a gaseous shielding layer, and into a reaction chamber filled with evaporated silane, and then passing the amorphous ribbon material through the gaseous shielding layer and out of the deposition apparatus;

cutting the amorphous ribbon material into a plurality of segments having a specified length;

stacking the plurality of segments of the amorphous ribbon material so that major surfaces of adjacent segments are opposed to one another with the thin insulating film therebetween to form a laminate; and toroidally winding the laminate.

2. The transformer according to claim 1, wherein the insulating thin film is formed on only one major surface of each of the plurality of layers of the amorphous ribbon forming the iron core.

3. The transformer according to claim 1, wherein the insulating thin film is formed on both opposing major surfaces of each of the plurality of layers of the amorphous ribbon forming the iron core.

4. The transformer according to claim 1, wherein at least one insulating thin film is formed on the surface of the amorphous ribbon.

5. A transformer comprising:

an iron core having a plurality of segments of an amorphous ribbon material having a vapor deposited insulating thin film formed from a silane material provided on at least one of two opposed major surfaces of each of the plurality of segments of the amorphous ribbon material, the plurality of segments being stacked, laminated and toroidally wound, the iron core is made by a process comprising the steps of:

unwinding an amorphous ribbon material from a hoop;

vapor depositing a thin insulating film of silane on at least one major surface of the amorphous ribbon material while the amorphous ribbon material is unwound from the hoop, wherein the step of vapor depositing a thin insulating film of silane comprises passing the amorphous ribbon material into a deposition apparatus, through a gaseous shielding layer, and into a reaction chamber filled with evaporated silane, and then passing the amorphous ribbon material through the gaseous shielding layer and out of the deposition apparatus;

cutting the amorphous ribbon material into a plurality of segments having a specified length;

stacking the plurality of segments of the amorphous ribbon material so that major surfaces of adjacent segments are opposed to one another with the thin insulating film therebetween to form a laminate; and toroidally winding the laminate; and an exciting coil.

6. The transformer according to claim 5, wherein the insulating thin film has a thickness of approximately 1 μm.

7. The transformer according to claim 5, wherein the silane material is a silicone material.

8. The transformer according to claim 7, wherein the insulating thin film has a thickness of approximately 1 μm.

9. The transformer according to claim 5, wherein the insulating thin film is formed on only one major surface of each of the plurality of segments of the amorphous ribbon forming the iron core.

10. The transformer according to claim 5, wherein the insulating thin film is formed on both opposing major surfaces of each of the plurality of segments of the amorphous ribbon forming the iron core.

11. The transformer according to claim 5, wherein the insulating thin film is formed and manufactured by vapor deposition treatment during a manufacturing process to machine an amorphous ribbon material into a transformer iron core.

* * * * *